US005460667A

United States Patent [19]

Moriyuki et al.

[11] Patent Number: 5,460,667

[45] Date of Patent: Oct. 24, 1995

[54] GAS GENERATING AGENT AND GAS GENERATOR FOR AUTOMOBILE AIR BAGS

[75] Inventors: Naosuke Moriyuki, Takasaki; Yoshimasa Yamamoto, Fujioka; Hajime Shimosada, Tokyo, all of Japan

[73] Assignee: Nippon Kayaku Kabushiki Kaisha, Tokyo, Japan

[21] Appl. No.: 199,327

[22] PCT Filed: Jul. 6, 1993

[86] PCT No.: PCT/JP93/00927

§ 371 Date: Mar. 2, 1994

§ 102(e) Date: Mar. 2, 1994

[87] PCT Pub. No.: WO94/01382

PCT Pub. Date: Jan. 20, 1994

[30] Foreign Application Priority Data

| | | | |
|---|---|---|---|
| Jul. 10, 1992 | [JP] | Japan | 4-206274 |
| Jul. 10, 1992 | [JP] | Japan | 4-206275 |
| Jul. 10, 1992 | [JP] | Japan | 4-206277 |
| Jul. 10, 1992 | [JP] | Japan | 4-206278 |

[51] Int. Cl.[6] ..... C06B 47/08

[52] U.S. Cl. ..... 149/36; 149/77; 149/83

[58] Field of Search ..... 149/61, 36, 9.1, 149/77, 83

[56] References Cited

U.S. PATENT DOCUMENTS

| | | | |
|---|---|---|---|
| 2,970,899 | 2/1961 | Ryker et al. | 52/1 |
| 3,929,530 | 12/1975 | Niles | 149/84 |
| 4,190,471 | 2/1980 | Flynn | 149/19.6 |
| 4,369,079 | 1/1983 | Shaw | 149/2 |
| 4,692,269 | 9/1987 | Kmiec et al. | 252/350 |
| 5,197,758 | 3/1993 | Lund et al. | 280/741 |

FOREIGN PATENT DOCUMENTS

| | | |
|---|---|---|
| 2093036 | 1/1982 | United Kingdom . |

OTHER PUBLICATIONS

J. Buckingham "Dictionary of Organic Compounds" 1987, Chapan & Hall London, GB Supplement 1; Edition 5 p. 181.

*Primary Examiner*—Donald P. Walsh
*Assistant Examiner*—Anthony R. Chi
*Attorney, Agent, or Firm*—Nields & Lemack

[57] ABSTRACT

A gas generating agent comprising at least one compound (A) selected from the group consisting of maleic hydrazide, carbohydrazide, thiocarbohydrazide and 3-methyl-5-pyrazolone and a gas generator containing said gas generating agent. The gas generating agent may optionally comprise an oxidant and a binder.

10 Claims, No Drawings

GAS GENERATING AGENT AND GAS GENERATOR FOR AUTOMOBILE AIR BAGS

INDUSTRIAL APPLICATION FIELD

The present invention relates to a gas generating agent and gas generator usable for an air bag equipped in a vehicle, such as an automobile or aircraft, to protect human body, in which the generated gas therefrom acts as a working gas in the air bag system.

PRIOR ART

At present, sodium azide has been mainly used in gas generating compositions useful for expansion of air bags. The compositions have no great problem regarding their combustion characteristics and have been widely put to practical uses. Sodium azide, however, essentially has many unfavorable properties. For example, having a high risk of its explosive decomposition and high spark sensitivity comparable to that of black powder, sodium azide is registered as one of B grade explosives in the United States of America and must be handled with great care. Actually, many accidents have occurred worldwide in the process for preparing a composition comprising sodium azide.

Additionally, the reaction of sodium azide with a heavy metal produces an salt having high impact sensitivity. Especially, the reaction with copper produces copper azide having very high impact sensitivity. Since copper metal and its alloys are frequently used in materials for vehicle parts, it may possibly become social problems to scrap air bags as the number of vehicles to be scrapped which are equipped with air bags increases.

Further, sodium azide has many problems in physiological toxicity and many cases concerning this toxicity have been reported: that is, one who had swallowed 0.04 g of sodium azide fell down on the floor while complaining of leg palsy and a violent chest pain which spread over the arms and which was similar to that of angina pectoris; and 39 years old man who had swallowed 0.05 to 0.06 g of sodium azide suddenly fainted with the incontinence of urine after 5 minutes and complained of nausea and a violent headache after 10 minutes.

Furthermore, the reaction of sodium azide with an acid results in the generation of hydrogen azide. This has some common properties with cyanogen or hydrogen sulfide and inhibits cytochrome oxidase. Sodium azide further causes many toxic symptoms, such as marked drop of blood pressure, convulsions, tachycardia followed by bradycardia, and ventricular fibrillation.

PROBLEMS THE INVENTION IS TO SOLVE

The invention provides a gas generating agent usable for air bags of vehicles, which may be easily manufactured and handled because of the inclusion of no sodium azide and wherein the combustion rate may be easily controlled and the combustion stability may be kept, and a gas generator containing the gas generating agent for air bags of vehicles.

MEANS FOR SOLVING THE PROBLEMS

The inventors have made great efforts to solve the above-mentioned problems and the invention has been accomplished.

The invention relates to:

(1) a gas generating agent comprising at least one compound (A) selected from the group consisting of maleic hydrazide, carbohydrazide, thiocarbohydrazide and 3-methyl-5-pyrazolone;

(2) a gas generating agent comprising at least one compound (A) selected from the group consisting of maleic hydrazide, carbohydrazide, thiocarbohydrazide and 3-methyl-5-pyrazolone, an oxidant and optionally a binder;

(3) the gas generating agent of (2) above, wherein said oxidant is an oxygen acid salt having a cation selected from alkali metals or alkaline earth metals and an anion which does not contain hydrogen;

(4) the gas generating agent of (3) above, wherein said oxygen acid salt is selected from the group consisting of nitrates, nitrites, chlorates and perchlorates;

(5) the gas generating agent of (1), (2), (3) or (4) above, which comprises 10% or more by weight of said compound (A), 90% or less by weight of said oxidant and 0 to 5% by weight of said binder;

(6) the gas generating agent of (1), (2), (3), (4) or (5) above, wherein said compound (A) is maleic hydrazide;

(7) the gas generating agent of (1), (2), (3), (4) or (5) above, wherein said compound (A) is carbohydrazide;

(8) the gas generating agent of (1), (2), (3), (4) or (5) above, wherein said compound (A) is thiocarbohydrazide;

(9) the gas generating agent of (1), (2), (3), (4) or (5) above, wherein said compound (A) is 3-methyl-5-pyrazolone;

(10) the gas generating agent of (1), (2), (3), (4) or (5) above, which is usable for air bags of vehicles;

(11) the gas generating agent of (6) above, which is usable for air bags of vehicles;

(12) the gas generating agent of (7) above, which is usable for air bags of vehicles;

(13) the gas generating agent of (8) above, which is usable for air bags of vehicles;

(14) the gas generating agent of (9) above, which is usable for air bags of vehicles;

(15) a gas generator containing the gas generating agent of (1), (2), (3), (4) or (5) above, which is usable for air bags of vehicles;

(16) a gas generator containing the gas generating agent of (6) above, which is usable for air bags of vehicles;

(17) a gas generator containing the gas generating agent of (7) above, which is usable for air bags of vehicles;

(18) a gas generator containing the gas generating agent of (8) above, which is usable for air bags of vehicles; and

(19) a gas generator containing the gas generating agent of (9) above, which is usable for air bags of vehicles.

The gas generating agent may consist of the compound (A) or comprise the compound (A) together with other component(s), such as an oxidant. In the latter, the gas generating agent preferably comprises 10% or more by weight, more preferably 15 to 90% by weight, most preferably 20 to 85% by weight, of the compound (A).

The oxidant may include various kinds of oxidants and be preferably an oxygen acid salt having a cation selected from alkali or alkaline earth metals and an anion which does not contain hydrogen. The oxidant includes alkali metal or alkaline earth metal salts of nitric acid, such as lithium nitrate, sodium nitrate, potassium nitrate, magnesium nitrate and barium nitrate; alkali metal or alkaline earth metal salts of nitrous acid, such as lithium nitrite, sodium nitrite, potassium nitrite, magnesium nitrite and barium nitrite; alkali metal or alkaline earth metal salts of chloric acid, such as sodium chlorate, potassium chlorate, lithium chlorate, barium chlorate, magnesium chlorate and calcium chlorate; and alkali metal or alkaline earth metal salts of perchloric acid, such as sodium perchlorate, potassium perchlorate, lithium perchlorate, barium perchlorate, magnesium perchlorate and calcium perchlorate.

When the oxidant is used the gas generating agent preferably comprises 90% or less by weight, more preferably 10 to 85% by weight, most preferably 15 to 80% by weight, of the oxidant.

A binder may be comprised in the gas generating agent and includes various kinds of binders, such as molybdenum disulfide. The gas generating agent may preferably comprise 0 to 5% by weight of the binder. When the binder is used the gas generating agent preferably comprises 0.1 to 5% by weight of the binder.

The gas generating agent of the invention may be obtained by mixing the component(s), preferably, in the form of powder. The mixing may be performed in the presence of water, if necessary. (When the gas generating agent consists of the compound (A), this compound per se is used as the gas generating agent and is preferably in powder form.) The gas generating agent may be formed in a desired shape, for example, in a granular or pellet shape, upon use thereof. The combustion rate of the gas generating agent can be easily varied by changing a load of a press to be applied for forming the agent and is in good consistency.

The gas generating agent of the invention is especially useful for the expansion of an air bag equipped in a stabilizing apparatus which is installed in a high speed movable vehicle, such as an automobile or aircraft, and which protects a human body by expanding an air bag (gas bag) at the moment of a crash.

Upon use the gas generating agent may be packed into, for example, a gas generator (inflater) equipped with an ignition device. Any conventionally known gas generator may be used. For example, conventional gas generators made of iron, aluminium, copper, various alloys or plastics and in cylindrical, hemispherical or spherical shape may be used. Further, the gas generator provided with holes in a suitable diameter or baffles may be used to control the direction and velocity of the generated gas flowing therefrom.

The gas generating agent packed into the gas generator may be ignited by means of a conventional way, for example, an electric current applied or mechanical impact. The gas generating agent is burnt by ignition and the gas then generated is fed into an air bag to expand the bag.

The compound (A) contained in the gas generating agent of the invention is very excellent in combustion properties demanded for an air bag: that is, the combustion rate of the gas generating agent varies linearly with the bulk density thereof and therefore easily controlled; the gas generating agent is stable in the combustion rate and excellent in prolonged stability with time; and further the volume of the gas generated per unit weight of the gas generating agent is far larger in comparison with that of the gas from sodium azide.

Additionally, handling of the compound (A) is very easy. In sodium azide, complete prevention of its moisture absorption is inevitable due to its hygroscopicity and toxicity of hydrogen azide generated from sodium azide. On the contrary, the gas generating agent of the invention based on the compound (A) has very low hygroscopicity and there is little necessity of preventing moisture absorption.

Furthermore, the compound (A) is very safe in comparison with sodium azide regarding toxicity: $LD_{50}$ of maleic hydrazide (CAS No. 123-33-1) in oral administration to rat being 3800 mg/kg, $LD_{50}$ of carbohydrazide (CAS No. 497-18-7) in intravenous injection to mouse being 120 mg/kg but $LD_{50}$ of sodium azide (CAS No. 26628-22-8) in oral administration to mouse being 27 mg/kg; further LDL0 of 3 -methyl-5-pyrazolone (CAS No. 108-26-9) in rat being 600 mg/kg but LDL0 of sodium azide (CAS No. 26628-22-8) in oral administration to mouse being 42 mg/kg. The compound (A) is far excellent in safety.

The compound (A) or a mixture thereof with other component(s) may be pressed to obtain aggregated pellets having enough strength as the gas generating agent for an air bag even in the absence of binder. A small portion of the binder, however, may be added to the gas generating agent. When a potassium salt is present in the gas generating agent the particularly preferred binder is molybdenum disulfide.

As shown in Examples, the combustion rate of the gas generating agent may be easily varied by changing a load of a press to be applied for the forming thereof and is in good consistency. Additionally, the gas generating agent of the invention is excellent in prolonged heat stability with time and has good reliability. Thus, the gas generating agent of the invention well satisfies the characteristics required when used in an inflater.

EXAMPLE

Hereinafter, the present invention will be illustratively explained with Examples.

Examples 1A to 6A

In the proportions shown in Table 1A, maleic hydrazide (MH) and an oxidant in powder form were homogeneously mixed by using a V-shaped mixer. The mixture was transferred into a mortar of 10 mm or 6 mm in diameter and pressed at a load of 600 kg/cm$^2$ or 300 kg/cm$^2$ to form pellets. The weight per pellet thus obtained is shown in Table 1A.

TABLE 1A

| Examples | MH (% by Weight) | Oxidant | Oxidant (% by Weight) | Diameter (mm) | Load (kg/cm$^2$) | Weight per Pellet(g) |
|---|---|---|---|---|---|---|
| 1A | 25.5 | $KClO_3$ | 74.5 | 10 | 600 | 1.00 |
| 2A | 25.5 | $KClO_3$ | 74.5 | 10 | 600 | 0.50 |
| 3A | 25.5 | $KClO_3$ | 74.5 | 6 | 300 | 0.25 |
| 4A | 25.5 | $KClO_3$ | 74.5 | 6 | 600 | 0.25 |
| 5A | 28.8 | $KClO_4$ | 71.2 | 6 | 600 | 0.25 |
| 6A | 28.8 | $KClO_4$ | 71.2 | 6 | 600 | 0.15 |

8.0 g or 7.5 g of the pellets thus obtained was packed into a bomb of 1L and ignited with a squib which comprised 3 mg of a fuse head consisting of diazodinitrophenol (DDNP) and 0.6 g of an igniter consisting of boron/potassium nitrate mixture (25/75). The relationship between increases in the pressure of the bomb and elapsed times was plotted and a time during which the pressure of the bomb was increasing was designated as a combustion time. Using the pellets obtained by the same manner as described above, experiments described above were repeated further three times and the combustion times obtained in each experiment are shown in Table 2A. As shown in Table 2A, the combustion times were well constant.

TABLE 2A

| Examples | Weight of Pellets Used(g) | Combustion Time (ms) 1st | 2nd | 3rd | 4th |
|---|---|---|---|---|---|
| 1A | 8.0 | 89 | 88 | 91 | 92 |
| 2A | 7.5 | 55 | 56 | 57 | 56 |
| 3A | 7.5 | 37 | 36 | 35 | 36 |
| 4A | 7.5 | 49 | 48 | 49 | 47 |
| 5A | 7.5 | 44 | 43 | 44 | 42 |
| 6A | 7.5 | 29 | 29 | 28 | 30 |

The number of moles of the gas generated by combustion of each gas generating agent in each Example was measured. Each gas generating agent of Example 1A, of Examples 2A to 4A or of Examples 5A and 6A generated 0.128 mol, 0.120 mol or 0.135 mol of the gas, respectively.

Example 7A 7.5 g of the pellets in Example 6A was burnt in the same manner as described in Example 1A after being kept at 120° C. for 240 hours to measure the quality thereof after storage at a high temperature environment. The obtained combustion times were 29, 28, 29 and 30 ms and were in good consistency as those of Example 6A.

Examples 1B to 6B

In the proportions shown in Table 1B, carbohydrazide (CH) and an oxidant in powder form were homogeneously mixed by using a V-shaped mixer. The mixture was transferred into a mortar of 10 mm or 6 mm in diameter and pressed at a load of 600 kg/cm$^2$ or 300 kg/cm$^2$ to form pellets. The weight per pellet thus obtained is shown in Table 1B.

TABLE 1B

| Examples | CH (% by Weight) | Oxidant | Oxidant (% by Weight) | Diameter (mm) | Load (kg/cm$^2$) | Weight per Pellet (g) |
|---|---|---|---|---|---|---|
| 1B | 30.6 | $KClO_3$ | 69.4 | 10 | 600 | 1.00 |
| 2B | 30.6 | $KClO_3$ | 69.4 | 10 | 600 | 0.50 |
| 3B | 30.6 | $KClO_3$ | 69.4 | 6 | 300 | 0.25 |
| 4B | 30.6 | $KClO_3$ | 69.4 | 6 | 600 | 0.25 |
| 5B | 34.2 | $KClO_4$ | 65.8 | 6 | 600 | 0.25 |
| 6B | 34.2 | $KClO_4$ | 65.8 | 6 | 600 | 0.15 |

8.0 g or 7.5 g of the pellets thus obtained was packed into a bomb of 1L and ignited with a squib which comprised 3 mg of a fuse head consisting of diazodinitrophenol (DDNP) and 0.6 g of an igniter consisting of boron/potassium nitrate mixture (25/75). The relationship between increases in the pressure of the bomb and elapsed times was plotted and a time during which the pressure of the bomb was increasing was designated as a combustion time. Using the pellets obtained by the same manner as described above, experiments described above were repeated further three times and the combustion times obtained in each experiment are shown in Table 2B. As shown in Table 2B, the combustion times were well constant.

TABLE 2B

| Examples | Weight of Pellets Used(g) | Combustion Time (ms) 1st | 2nd | 3rd | 4th |
|---|---|---|---|---|---|
| 1B | 8.0 | 141 | 140 | 143 | 142 |
| 2B | 7.5 | 105 | 106 | 107 | 106 |
| 3B | 7.5 | 67 | 66 | 65 | 66 |
| 4B | 7.5 | 89 | 88 | 89 | 87 |
| 5B | 7.5 | 116 | 119 | 117 | 117 |
| 6B | 7.5 | 81 | 80 | 79 | 81 |

The number of moles of the gas generated by combustion of each gas generating agent in each Example was measured. Each gas generating agent of Example 1B, of Examples 2B to 4B and of Examples 5B and 6B generated 0.163 mol, 0.153 mol and 0.171 mol of the gas, respectively.

Example 7B 7.5 g of the pellets in Example 6B was burnt in the same manner as described in Example 1B after being kept at 120° C. for 240 hours to measure the quality thereof after storage at a high temperature environment. The combustion times thus measured were 78, 82, 81 and 80 ms and were in good consistency as those of Example 6B.

Examples 1C to 6C

In the proportions shown in Table 1C, thiocarbohydrazide (TCH) and an oxidant in powder form were homogeneously mixed by using a V-shaped mixer. The mixture was transferred into a mortar of 10 mm or 6 mm in diameter and pressed at a load of 600 kg/cm$^2$ or 300 kg/cm$^2$ to form pellets. The weight per pellet thus obtained is shown in Table 1C.

TABLE 1C

| Examples | TCH (% by Weight) | Oxidant | Oxidant (% by Weight) | Diameter (mm) | Load (kg/cm$^2$) | Weight per Pellet(g) |
|---|---|---|---|---|---|---|
| 1C | 27.0 | $KClO_3$ | 73.0 | 10 | 600 | 1.00 |
| 2C | 27.0 | $KClO_3$ | 73.0 | 10 | 600 | 0.50 |
| 3C | 27.0 | $KClO_3$ | 73.0 | 6 | 300 | 0.25 |
| 4C | 27.0 | $KClO_3$ | 73.0 | 6 | 600 | 0.25 |
| 5C | 30.4 | $KClO_4$ | 69.6 | 6 | 600 | 0.25 |
| 6C | 30.4 | $KClO_4$ | 69.6 | 6 | 600 | 0.15 |

8.0 g or 7.5 g of the obtained pellets was packed into a bomb of 1L and ignited with a squib which comprised 3 mg of a fuse head consisting of diazodinitrophenol (DDNP) and 0.6 g of an igniter consisting of boron/potassium nitrate mixture (25/75). The relationship between increases in the pressures of the bomb and elapsed times was plotted and a time during which the pressure of the bomb was increasing was designated as a combustion time. Using the pellets obtained by the same manner as described above, experiments described above were repeated further three times and the combustion times obtained in each experiment are shown in Table 2C. As shown in Table 2C, the combustion times were well constant.

TABLE 2C

| Examples | Weight of Pellets Used(g) | Combustion Time (ms) 1st | 2nd | 3rd | 4th |
|---|---|---|---|---|---|
| 1C | 8.0 | 139 | 138 | 141 | 142 |
| 2C | 7.5 | 65 | 66 | 67 | 66 |
| 3C | 7.5 | 47 | 46 | 45 | 46 |
| 4C | 7.5 | 69 | 68 | 69 | 67 |
| 5C | 7.5 | 126 | 129 | 127 | 127 |
| 6C | 7.5 | 91 | 90 | 89 | 91 |

The number of moles of the gas generated in combustion of each gas generating agent in each Example was measured. Each gas generating agent of Example 1C, of Examples 2C to 4C and of Examples 5C and 6C generated 0.143 tool, 0.134 mol and 0.151 mol of the gas, respectively.

Example 7C 7.5 g of the pellets in Example 6C was burnt in the same manner as described in Example 1C after being kept at 120° C. for 240 hours to measure the quality thereof after storage at a high temperature environment. The combustion times thus measured were 88, 92, 91 and 90 ms and were in good consistency as those of Example 6C.

Examples 1D to 6D

In the proportions shown in Table 1D, 3-methyl-5-pyrazolone (MP) and an oxidant in powder form were homogeneously mixed by using a V-shaped mixer. The mixture was transferred into a mortar of 10 mm or 6 mm in diameter and pressed at a load of 600 kg/cm$^2$ or 300 kg/cm$^2$ to form pellets. The weight per pellet thus obtained is shown in Table 1D.

TABLE 1D

| Examples | MP (% by Weight) | Oxidant | Oxidant (% by Weight) | Diameter (mm) | Load (kg/cm$^2$) | Weight per Pellet(g) |
|---|---|---|---|---|---|---|
| 1D | 19.3 | $KClO_3$ | 80.7 | 10 | 600 | 1.00 |
| 2D | 19.3 | $KClO_3$ | 80.7 | 10 | 600 | 0.50 |
| 3D | 19.3 | $KClO_3$ | 80.7 | 6 | 300 | 0.25 |
| 4D | 19.3 | $KClO_3$ | 80.7 | 6 | 600 | 0.25 |
| 5D | 22.0 | $KClO_4$ | 78.0 | 6 | 600 | 0.25 |
| 6D | 22.0 | $KClO_4$ | 78.0 | 6 | 600 | 0.15 |

8.0 or 7.5 g of the pellets thus obtained was packed into a bomb of 1L and ignited with a squib which comprised 3 mg of a fuse head consisting of diazodinitrophenol (DDNP) and 0.6 g of an igniter consisting of boron/potassium nitrate mixture (25/75). The relationship between increases in the pressure of the bomb and elapsed times was plotted and a time during which the pressure of the bomb was increasing was designated as a combustion time. Using the pellets obtained by the same manner as described above, experiments described above were repeated further three times and the combustion times obtained in each experiment are shown in Table 2D. As shown in Table 2D, the combustion times were well constant.

TABLE 2D

| Examples | Weight of Pellets Used(g) | Combustion Time (ms) 1st | 2nd | 3rd | 4th |
|---|---|---|---|---|---|
| 1D | 8.0 | 85 | 85 | 87 | 86 |
| 2D | 7.5 | 50 | 51 | 52 | 51 |
| 3D | 7.5 | 41 | 42 | 40 | 42 |
| 4D | 7.5 | 46 | 46 | 45 | 44 |
| 5D | 7.5 | 37 | 36 | 38 | 37 |
| 6D | 7.5 | 31 | 32 | 31 | 30 |

The number of moles of the gas generated by combustion of each gas generating agent of each Example was measured. Each gas generating agent of Example 1D, of Examples 2D to 4D and of examples 5D and 6D generated 0.126 mol, 0.119 mol and 0.135 mol of the gas, respectively.

Example 7D 7.5 g of the pellets in Example 6D was burnt in the same manner as described in Example 1D after being kept at 120° C. for 240 hours to measure the quality thereof after storage at a high temperature environment. The combustion time thus measured were 31, 32, 30 and 30 ms and were in good consistency as those of Example 6D.

Example 1E

Each of the pellets obtained in Examples 1A to 6A, 1B to 6B, 1C to 6C and 1D to 6D was examined by a combustion test wherein a known cylindrical gas generator provided with an ignition device for air bags of vehicles was packed with each of the pellets. In all instances, the combustion rate thereof and the volume of the generated gas therefrom suitable for air bags of vehicles were obtained.

EFFECT OF THE INVENTION

As containing the compound (A) easy to be handled and having very low toxicity instead of sodium azide which is dangerous in its handling and physiologically harmful, the gas generating agent of the invention has good combustion stability required in an inflater.

What is claimed is:

1. A gas generating agent for air bags of vehicles, comprising at least one compound (A) selected from the group consisting of maleic hydrazide, carbohydrazide, and 3-methyl-5-pyrazolone, an oxidant comprising a chlorate or perchlorate having a cation selected from the group consisting of alkali metals and alkaline earth metals, and. optionally a binder.

2. The gas generating agent of claim 1, which comprises 10% or more by weight of said compound (A), 90% or less by weight of said oxidant and 0 to 5% by weight of said binder.

3. The gas generating agent of claim 1 or 2, wherein said compound (A) is maleic hydrazide.

4. The gas generating agent of claim 1 or 2, wherein said compound (A) is carbohydrazide.

5. The gas generating agent of claim 1 or 2, wherein said compound (A) is 3-methyl-5-pyrazolone.

6. A vehicle air bag gas generator comprising a gas generating agent comprising at least one compound (A) selected from the group consisting of maleic hydrazide, carbohydrazide and 3 -methyl-5-pyrazolone, an oxidant comprising a chlorate or perchlorate having a cation selected from the group consisting of alkali metals and alkaline earth metals, and optionally a binder; and means for igniting said gas generating agent.

7. The vehicle air bag gas generator of claim 6, which comprises 10% or more by weight of said compound (A) , 90% or less by weight of said oxidant and 0 to 5% by weight of said binder.

8. The vehicle air bag gas generator of claim 6 or 7, wherein said compound (A) is maleic hydrazide.

9. The vehicle air bag gas generator of claim 6 or 7, wherein said compound (A) is carbohydrazide.

10. The vehicle air bag gas generator of claim 6 or 7, wherein said compound (A) is 3-methyl-5-pyrazolone.

* * * * *